United States Patent [19]

Vogt

[11] Patent Number: 4,572,413

[45] Date of Patent: Feb. 25, 1986

[54] RESEALABLE CLOSURE ASSEMBLY FOR A CONTAINER

[76] Inventor: Kuno J. Vogt, 4250 1/2 Fairmount Ave., San Diego, Calif. 92105

[21] Appl. No.: 429,102

[22] Filed: Sep. 30, 1982

[51] Int. Cl.[4] ..... B05B 11/04

[52] U.S. Cl. ..... 222/528; 222/530

[58] Field of Search ..... 229/7 R, 17 R, 43, 45 R; 221/306; 222/421, 460, 498, 528, 531, 538, 541, 544, 478, 482, 526, 527, 529, 530, 511, 513; 383/88, 89, 92, 85, 87; 220/66, 67, 70; 141/113, 325, 327; D9/341, 347, 375, 376, 370

[56] References Cited

U.S. PATENT DOCUMENTS

| | | | |
|---|---|---|---|
| 1,225,017 | 5/1917 | Decker | 222/530 |
| 1,467,009 | 9/1923 | Peterson | 229/7 R X |
| 1,635,070 | 7/1927 | Clark | 215/2 |
| 1,945,612 | 2/1934 | Lacher | 222/511 X |
| 2,685,385 | 8/1954 | Kuss | 222/528 X |
| 3,323,694 | 6/1967 | Stevens, Jr. | 222/530 X |
| 3,392,887 | 7/1968 | Bross | 222/528 |
| 3,933,268 | 1/1976 | Buske | 220/23.4 |
| 4,153,089 | 5/1979 | Vielleux | 222/530 X |

FOREIGN PATENT DOCUMENTS

| | | | |
|---|---|---|---|
| 623304 | 7/1961 | Canada | 215/2 |
| 1091180 | 11/1967 | United Kingdom | 222/527 |

*Primary Examiner*—Stanley H. Tollberg

*Attorney, Agent, or Firm*—Charles C. Logan, II

[57] ABSTRACT

A resealable closure assembly for a container with integral closing/opening and resealing structure. The resealable closure assembly has a neck portion that is wider at its bottom than at its top. The shape of the neck portion is generally conical or frusto-conical. At least one dispensing aperture is formed in the upper area of the neck portion. A laterally extending fold line is formed in the neck portion spaced downwardly from its top end and any dispensing apertures therein. The top of the neck portion is foldable downwardly about the fold line in order to seal off the dispensing apertures in the upper area of the neck portion. Protrusions are formed integrally on the outer surface of the neck portion for detachably securing the top end of the neck portion against the area of the neck portion located below the fold line. The closure assembly is generally made of a flexible material such as plastic. The closure assembly may have a bottom wall attached to its lower end, it may have a tubular member attached to its lower end internally threaded, or it may have a tubular member that forms part of a container attached to its bottom end.

16 Claims, 19 Drawing Figures

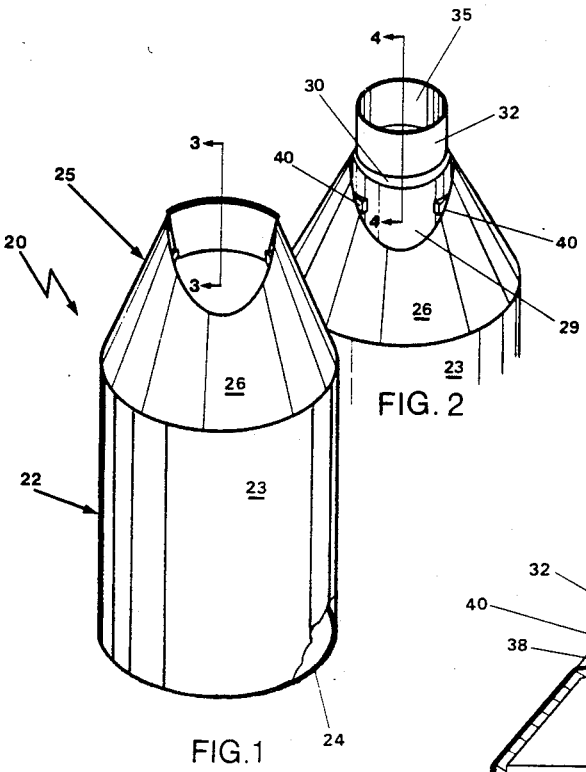
FIG. 2
FIG. 1
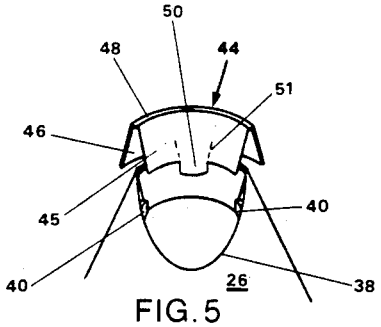
FIG. 5
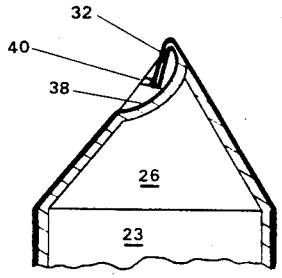
FIG. 3
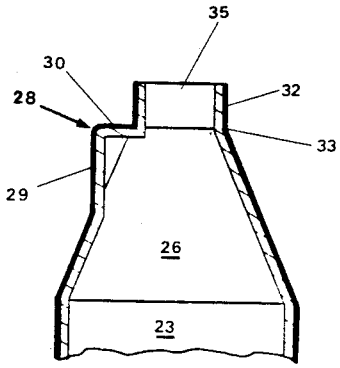
FIG. 4
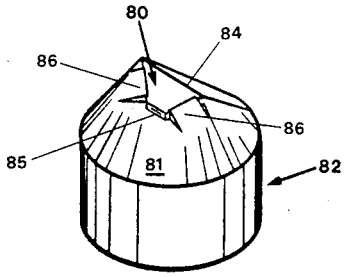
FIG. 6
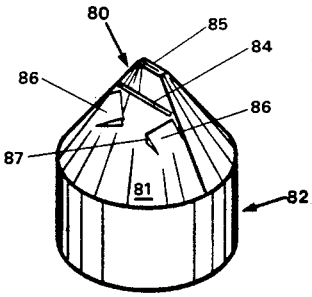
FIG. 7
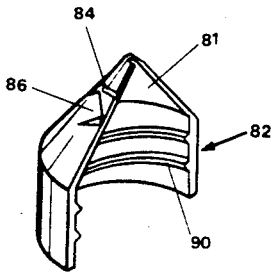
FIG. 8
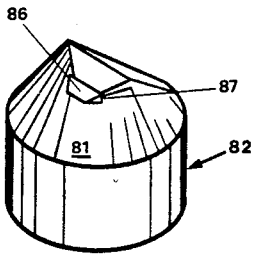
FIG. 9

RESEALABLE CLOSURE ASSEMBLY FOR A CONTAINER

BACKGROUND OF THE INVENTION

The invention relates in general to a closure assembly for a container and more specifically to a closure assembly that can be formed integrally on a container and having its own closing/opening and resealing structure.

The popularity of the conventional pop-top beverage container caused the problem of littering resulting from improper disposal of the tear tab that was detached from the open container. In order to overcome this problem, beverage containers now have a tab on them which once it is actuated to open the container, it will still remain attached to the container. These self attached tabs are expensive to manufacture and still have the problem that once the container has been opened, there is no way of resealing it if the person does not want to drink all of the beverage within the container at that time.

It is an object of the invention to provide a novel resealable closure assembly for a container that is non-detachable from the container.

It is also an object of the invention to provide a novel resealable closure assembly for a container that may be utilized in forming a one-piece injection-blow moldable plastic container with an integral resealable closure.

It is an additional object of the invention to provide a novel resealable closure assembly for a container that is inexpensive to manufacture.

It is an additional object of the invention to provide a novel resealable closure assembly that can be used with an incredible variety of containers in addition to beverage containers.

SUMMARY OF THE INVENTION

The resealable closure assembly is preferably used with a one-piece injection-blow moldable plastic container. The closure assembly has a neck portion that is wider at its bottom than at its top and in several preferred embodiments has a conical or frusto conical shape. There is at least one dispensing aperture in the upper area of the neck portion. A laterally extending fold line is located in the neck portion spaced downwardly from its top end and any dispensing apertures therein. The top end of the neck portion is foldable downwardly about the fold line in order to seal off any dispensing apertures in the upper area of the neck portion. There are integrally fomred protrusions extending outwardly from predetermined positions on the neck portion for detachably securing the top end of the neck portion against the area of the neck portion located below the fold line.

In one of the embodiments of the resealable closure assembly, there is a tubular extension formed at the top of the frusto-conical neck portion. The container is closed by squeezing shut the tubular member at its base, then folding the flatened tubular extension over and into the concave recess formed by the previous neck-bulge portion. Protrusions on the side of the neck bulge portion become the hold-in catches for the folded over portion of the closure. The closure is opened by pulling the fold-over out of the recess and upwardly. A lateral squeeze at the base of the tubular extension forces the neck bulge out, thereby keeping the closure open for pouring or drinking. This closure assembly is ideally suited for containers for beverages, such as fruit juices, carbonated soft drinks, beer, etc.

It is expected that the embodiment of the closure assembly described above will work effectively with beverages containing carbonation pressures. As a safeguard, a clip securing member could be added on the previously described closure.

In other embodiments using the novel resealable closure assembly, it may be used on dispensing tubes, it may be used as a screw closure for a container, or it can be used as a one-piece closure assembly and container.

Where the novel resealable closure assembly is used on a container that is bottom-fillable, applicant has developed a novel structure for the bottom of the container. The bottom wall of the container has an annular lip extending downwardly from its bottom surface and has a pair of diametrically opposed cut-out notch portions therein. The bottom wall has a filling aperture in it and a tubular filling spout surrounds this aperture and extends downwardly therefrom. The cut-out portions allow the container to be filled while traveling through a conveyor type filling operation and would also allow the tubular filling spout to be pressed between two heated conveyor belts which would press the tubular sleeve together and seal it in one operation.

The novel resealable closure assembly can also be used with blow-molded, one-piece, containers that are nestable, thereby providing a savings in space when storing such containers.

DESCRIPTION OF THE DRAWINGS

FIG. 1 is a perspective view of a container having the novel resealable closure assembly and showing it in its closed position;

FIG. 2 is a partial perspective view of the novel resealable closure assembly in its open position;

FIG. 3 is a partial cross-sectional view taken along lines 3—3 of FIG. 1;

FIG. 4 is a cross-sectional view taken along lines 4—4 of FIG. 2;

FIG. 5 is a perspective view illustrating a clip securing member that can be used with the closure assembly illustrated in FIGS. 1–4;

FIG. 6 is a perspective view of a first alternative novel closure assembly with it in its closed position;

FIG. 7 is a perspective view of the first alternative novel closure assembly shown in its open position;

FIG. 8 is a cross-sectional view taken through the first alternative embodiment;

FIG. 9 is a perspective view of a slight variation on the first alternative novel closure assembly;

DESCRIPTION OF THE PREFERRED EMBODIMENT

Figure 10:
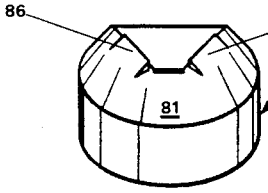
FIG. 10 is a perspective view of a variation of the first alternative novel closure assembly and is shown in its closed position.

The novel resealable closure assembly for a container will be described by referring to the Figures of the drawing. Throughout the different Figures, the like structural elements will be designated by the same numbers.

The container in FIGS. 1–5 is generally designated numeral 20. The container has a body 22 formed from a tubular member 23, a bottom wall 24, and the resealable closure assembly 25.

The resealable closure assemble 25 has a frusto-conical neck portion 26. A neck bulge 28 forms part of the neck portion 26 and it has an upright portion 29 and a top wall portion 30. A tubular extension 32 extends upwardly from the top of neck portion 26 and it has a fold line 33 where the two meet. A circular shaped opening 35 is formed in tubular extension 32 and it is the pouring spout.

The resealable closure assembly is illustrated in its open position in FIG. 4. When it is desired to close the assembly, the tubular extension is compressed inwardly along with the neck bulging portion and a concave recess 38 is formed as illustrated in FIG. 3. The compressed tubular extension 32 is then folded downwardly about fold line 33 and captured between protrusions 40 that are integrally formed on the neck portion 26. These protrusions 40 may have an undercut surface to aid in capturing the lateral edges of the compressed tubular extension 32.

In applications wherein the container is used with carbonated beverages, the clip securing member 44 may be utilized. It has a front wall 45 and a rear wall 46 that meet at their top edge along fold edge 48. Clip securing member 44 when inserted onto the resealable closure assembly 25 would also be captured by protrusions 40. When it would be desired to remove the clip securing member 44, it would be gripped by tab 50 and torn along weakened tear lines 51 and then easily removed. Since the preferred embodiment for the closure assembly would be utilized with a blow-formed plastic container, the securing clip member 44 would also generally be made from plastic material.

Figure 17:
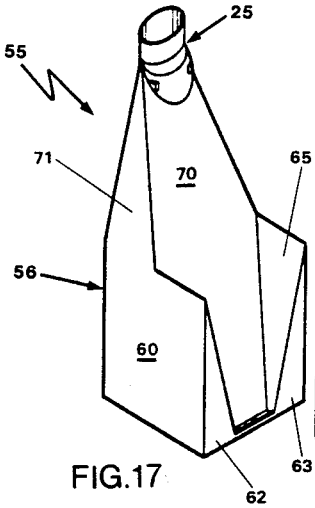
FIGS. 17–19 illustrate the novel resealable closure assembly attached to a container having a novel stackable configuration.
Figure 18:
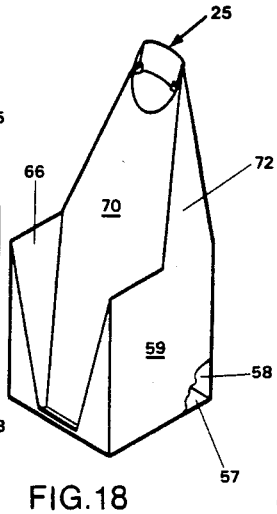
Figure 19:
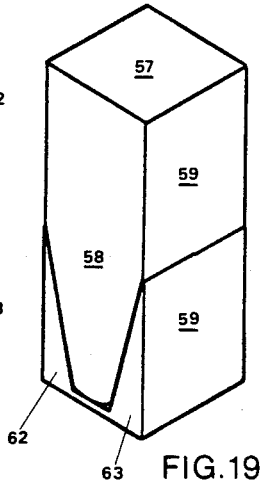

The novel resealable closure assembly 25 is also illustrated on the containers seen in FIGS. 17–19 wherein the containers 55 have a different configuration so that they may be nestable or stackable in a most efficient compact manner. These containers have a body 55 having a bottom wall 57, a rear wall 58, outside side walls 59 and 60, front wall sections 62 and 63, and inside walls 65 and 66. The neck portion 70 also doubles as a front wall as does the rear wall 58 double as a part of the neck portion 70. The neck also has side walls 71 and 72.

A first alternative resealable closure assembly 80 is illustrated in FIGS. 6–14. The closure assembly has a conical top neck portion 81 that is attached to the top of tubular member 82. The upper portion of conical neck portion 81 has a horizontal fold line 84 about which the top of the neck portion is folded after it has been compressed. A slot shaped opening 85 is formed at the top end of neck portion 81. A pair of protrusions 86 are integrally formed and extend outwardly from neck portion 81. The protrusions 86 have undercut surfaces 87 to aid in capturing the compressed folded over neck portion 81. As seen in FIG. 8, tubular member 82 has internal threads 90 so that it may be threaded on to a container.

The resealable closure assembly 80 is illustrated in FIG. 9 with a slight variation in that it only has a single protrusion 86 which then would capture the upper tip of conical top neck portion 81 when it has been folded in its sealed state.

Figure 11:
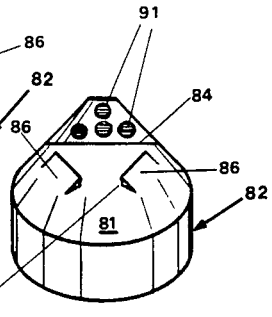
FIG. 11 is a perspective view of the novel closure assembly illustrated in FIG. 10, but in its open position.

In FIGS. 10 and 11 the resealable closure assembly 80 is used on a cap for a condiment container such as a salt or pepper shaker. It has a plurality of apertures 91 which are spaced downwardly from the tip of the conical top neck portion 81.

Figure 12:
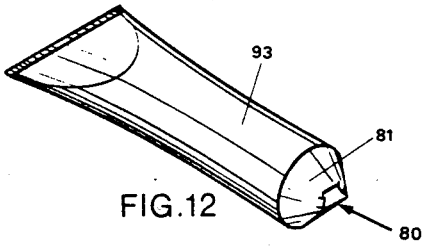
FIG. 12 is a perspective view illustrating the first alternative closure assembly formed on a squeezable dispensing container.
Figure 13:
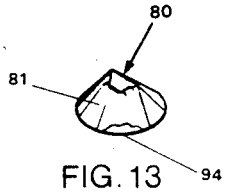
FIG. 13 is a perspective view of the first alternative closure assembly illustrating it as being used as asmall salt or other condiment dispensing package.

A squeezeable container such as a tube of toothpaste is illustrated in FIG. 12 with the novel resealable closure assembly 80 formed on the top end of tubular member 93. A small unitized condiment container is illustrated in FIG. 13 having the novel resealable closure assembly 80. It has a conical neck portion 81 and a bottom wall 94.

Figure 14:
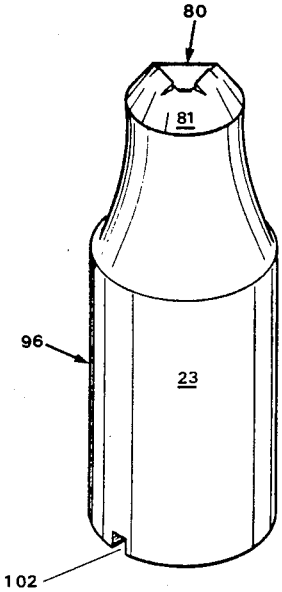
FIG. 14 is a perspective view of the first alternative novel closure assembly illustrating it on the top of a container having a different configuration.
Figure 15:
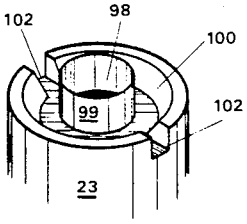
FIG. 15 is a partial perspective view of the bottom of the container illustrated in FIG. 14.
Figure 16:
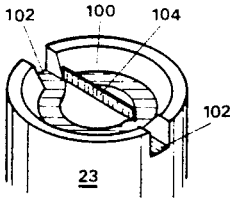
FIG. 16 is a partial perspective view of the bottom of the container illustrated in FIG. 14 after the tubular filling spout has been seam sealed.

A container 96 is illustrated in FIGS. 14–16 and it also has the novel resealable closure assembly 80 formed on its top structure. For convenience in filling such a container, novel bottom structure has been designed and this is illustrated in FIGS. 15 and 16. The bottom wall 97 has an aperture 98 in it and it is surrounded by a tubular filling spout 99 that extends downwardly from the bottom wall 97. An annular lip 100 has diametrically opposed cutout notch portions 102. After the container has been filled, it may pass along a conveyor through a set of heated conveyor bands that will engage tubular filling spout 99 and press it together and produce a sealed seam 104.

What is claimed is:

1. A resealable closure assembly for a container comprising:

a neck portion that is wider at its bottom than at its top;

a tubular extension extends upwardly from the top of said neck portion and it has a fold line where the two meet;

said neck portion having a bulge that protrudes outwardly from said neck portion when said tubular extension extends upwardly in its unfolded state, said bulge having an upright portion and a top wall portion, said bulge being deformable inwardly to seal off the top of said neck which allows said tubular member to be folded downwardly about said fold line; and means integrally formed on said neck portion for detachably securing said tubular extension against the area of said neck portion located below said fold line, when said tubular extension is secured against said inwardly deformed bulge, substantially the entire longitudinal length of said tubular extension is sealed together in a concave cross-sectional configuration.

2. A resealable closure as recited in claim 1 wherein said neck portion is made of a flexible material that is foldable or bendable.

3. A resealable closure assembly as recited in claim 2 wherein said material is plastic.

4. A resealable closure as recited in claim 1 wherein said neck portion is substantially conical in shape.

5. A resealable closure assembly as recited in claim 2 further comprising a tubular member that is connected to the lower end of said neck portion.

6. A resealable closure assembly as recited in claim 5 wherein said tubular member is internally threaded so that it may be threadably attached to the top of a container.

7. A resealable closure assembly for a container comprising:

a neck portion that is wider at its bottom than at its top and which is substantially conical in shape;

at least one dispensing aperture in the upper area of said neck portion;

a preformed laterally extending fold line in said neck portion spaced downwardly from its top end and any dispensing apertures therein, the top end of said neck portion being foldable downwardly about said preformed fold line in order to seal off any dispensing apertures in the upper area of said neck portion, substantially the entire longitudinal length of said neck portion between its top end and said fold line are sealed flat together across its width to form a trapezoidal shape when the top end of said neck portion is folded downwardly into its closed position; and squeeze release locking means for capturing the lateral edges of the sealed flat top end of said neck portion integrally formed on said neck portion for detachably securing the top end of said neck portion against the area of said neck portion located below said preformed fold line.

8. A resealable closure assembly as recited in claim 7 wherein said aperture is at the top of said neck portion and it is formed in the shape of a slit.

9. A resealable closure assembly as recited in claim 7 wherein said means for detachably securing the top end of said neck portion is at least one protrusion having an edge surface that matingly engages an edge of said folded over neck portion.

10. A resealable closure assembly as recited in claim 9 wherein the edge on said protrusions have an undercut surface.

11. A resealable closure assembly as recited in claim 9 wherein their are two protrusions and their respective mating edges are oriented toward each other in the form of a v-shape that is not connected at its bottom.

12. A resealable closure assembly as recited in claim 7 further comprising a substantially flat bottom wall connect to the lower end of said neck portion.

13. A resealable closure assembly as recited in claim 5 wherein said tubular member forms the body of a container and there is a bottom wall at the lower end of said tubular member.

14. A resealable closure assembly as recited in claim 13 further comprising a annular lip extending downwardly from said bottom wall, said lip having a pair of cut-out notch portions diametrically opposed to each other.

15. A resealable closure assembly as recited in claim 14 wherein is said bottom wall has a filling aperture therein and a tubular filling spout surrounding said aperture and extending downwardly therefrom.

16. A resealable closure assembly as recited in claim 1 further comprising a clip securing member that is matingly engaged on the top end of said neck portion when pressed downwardly on said fold line.

* * * * *